US006085874A

United States Patent [19]

Uchino et al.

[11] Patent Number: 6,085,874

[45] Date of Patent: Jul. 11, 2000

[54] RAIL-CLIMBING ELEVATOR COUNTERWEIGHT HAVING FLAT MACHINES

[75] Inventors: Yasunobu Uchino, Yokohama; Kenji Nakagawa, Tokyo; Hirofumi Yuda; Masaharu Ueda, both of Saitama; Yasuhisa Shioda, Tokyo; Takayuki Nagashima, Kawasaki, all of Japan

[73] Assignee: Otis Elevator Company, Farmington, Conn.

[21] Appl. No.: 09/218,787

[22] Filed: Dec. 22, 1998

[51] Int. Cl.[7] ..... B66B 9/02

[52] U.S. Cl. ..... 187/404; 187/411; 187/289; 187/250

[58] Field of Search ..... 187/404, 405, 187/406, 410, 411, 250, 289, 251

[56] References Cited

U.S. PATENT DOCUMENTS

| | | | |
|---|---|---|---|
| 1,071,309 | 8/1913 | Goggin . | |
| 2,405,691 | 8/1946 | Ellis . | |
| 3,101,130 | 8/1963 | Bianca . | |
| 4,570,753 | 2/1986 | Ohta et al. | 187/1 |
| 4,949,815 | 8/1990 | Pavoz | 187/20 |
| 5,062,501 | 11/1991 | Pavoz et al. . | |
| 5,127,493 | 7/1992 | Yasuda et al. | 187/406 X |
| 5,429,211 | 7/1995 | Aulanko et al. | 187/254 |
| 5,435,417 | 7/1995 | Hakala | 187/404 |
| 5,469,937 | 11/1995 | Hakala et al. | 187/266 |
| 5,490,578 | 2/1996 | Aulanko et al. | 187/254 |
| 5,566,785 | 10/1996 | Hakala | 187/250 |
| 5,573,084 | 11/1996 | Hakala | 187/252 |
| 5,713,432 | 2/1998 | Richter et al. | 187/250 |
| 5,725,074 | 3/1998 | Richter et al. | 187/406 |

FOREIGN PATENT DOCUMENTS

| | | | |
|---|---|---|---|
| 1 032 496 | 6/1958 | Australia . | |
| 0 565 516 | 4/1993 | European Pat. Off. . | |
| 0 606 875 A1 | 1/1994 | European Pat. Off. . | |
| 0 779 233 A2 | 6/1994 | European Pat. Off. . | |
| 0 784 030 A2 | 6/1994 | European Pat. Off. . | |
| 0 688 735 A2 | 6/1995 | European Pat. Off. . | |
| 0 710 618 A2 | 10/1995 | European Pat. Off. . | |
| 0 749 930 A2 | 6/1996 | European Pat. Off. . | |
| 0 749 931 A2 | 6/1996 | European Pat. Off. . | |
| 2 640 604 | 12/1988 | France . | |
| 3834790 A1 | 10/1988 | Germany . | |
| 296 15 921 U1 | 4/1997 | Germany . | |
| 1-242386 | 9/1989 | Japan . | |
| 4-55277 | 2/1992 | Japan | 187/404 |
| 4-55278 | 2/1992 | Japan | 187/404 |
| 1 401 197 | 6/1972 | United Kingdom . | |
| 2 138 397 | 11/1985 | United Kingdom . | |
| 2 2-1 657 | 8/1990 | United Kingdom . | |
| WO 96/09978 | 4/1996 | WIPO . | |
| PCT/FI97/00823 | 12/1997 | WIPO . | |
| PCT/FI97/00824 | 12/1997 | WIPO . | |

OTHER PUBLICATIONS

"Elevator Mechanical Design, Principles and Concepts", by Lubomir Janovsky, Ellis Horwood Limited (1987).

"Hannover Fair: Another new idea from ContiTech—Lifting belts for elevators", ContiTech initiativ Jan. 1998 (Hannover Fair '98).

*Primary Examiner*—Robert P. Olszewski
*Assistant Examiner*—Thuy V. Tran

[57] ABSTRACT

An elevator system includes a counterweight assembly having a plurality of drive machines having integrally formed drive wheels adapted to frictionally engaged a guide rail for driving the counterweight assembly along the guide rail to effect movement of an elevator car.

10 Claims, 3 Drawing Sheets

RAIL-CLIMBING ELEVATOR COUNTERWEIGHT HAVING FLAT MACHINES

FIELD OF THE INVENTION

The present invention relates to elevator machines and systems and, more particularly, to elevator machines and systems utilizing a counterweight having flat drive machines mounted thereon and being adapted to climb a rail.

BACKGROUND AND SUMMARY OF THE INVENTION

Various design solutions exist for constructing elevator systems that optimize space while gaining cost and performance benefits. By conserving space, building complexity and costs are reduced. Various designs exist for elevator systems that eliminate the need for a machine room by housing most or all of the elevator components within the hoistway. Machines located within a hoistway are more readily accessible for servicing. In order to fit within a hoistway, various conventional elevator components must be eliminated or re-configured. Some existing designs provide for machines mounted along side an elevator car or counterweight travel path. Others provide for mounting a machine in a pit or overhead area of a hoistway. Each of these designs requires complexity and imposes space limitations.

High performance elevators require direct coupling between a motor and drive sheave in order to provide smooth, low vibration performance. The lack of a gearbox requires the machine to produce high torque at low operating speeds relative to industrial machines of the same power output rating. This results in motors that are large and expensive relative to industrial machines of the same power output. The size and cost of conventional high-performance gearless machines makes it impractical to implement them in rope-climbing elevator designs, which are desirable for various reasons including optimization of hoistway space and convenient accessibility. Geared machines are undesirable for certain applications such as rope-climbing systems because they introduce vibrations and inefficiencies.

It is therefore an object of the present invention to provide an elevator system that minimizes space requirements, eliminates the need for a machine room, and provides convenient access to machine components. It is a further object to provide an elevator machine that includes the output and low vibration benefits of a high performance machine, while providing a lightweight and efficiency benefits of a gearless machine. These and other objects are achieved by the invention described herein.

Among the ways to eliminate and reduce the size of elevator components is to replace hydraulic and geared elevator machines with gearless ones, enabling generally flatter profiles. The "flat" machines are more readily adapted for positioning within the hoistway and provide mechanical advantages over geared or linear induction motors. According to the present invention, an elevator system including a counterweight assembly having a plurality of flat drive machines enabling the counterweight assembly to climb a vertical rail in the hoistway is provided. The drive machines include permanent magnet motors and friction drive wheels for engaging the rail. The counterweight assembly is roped to n elevator car for corresponding vertical movement therewith.

DESCRIPTION OF THE PREFERRED EMBODIMENT

Figure 1:
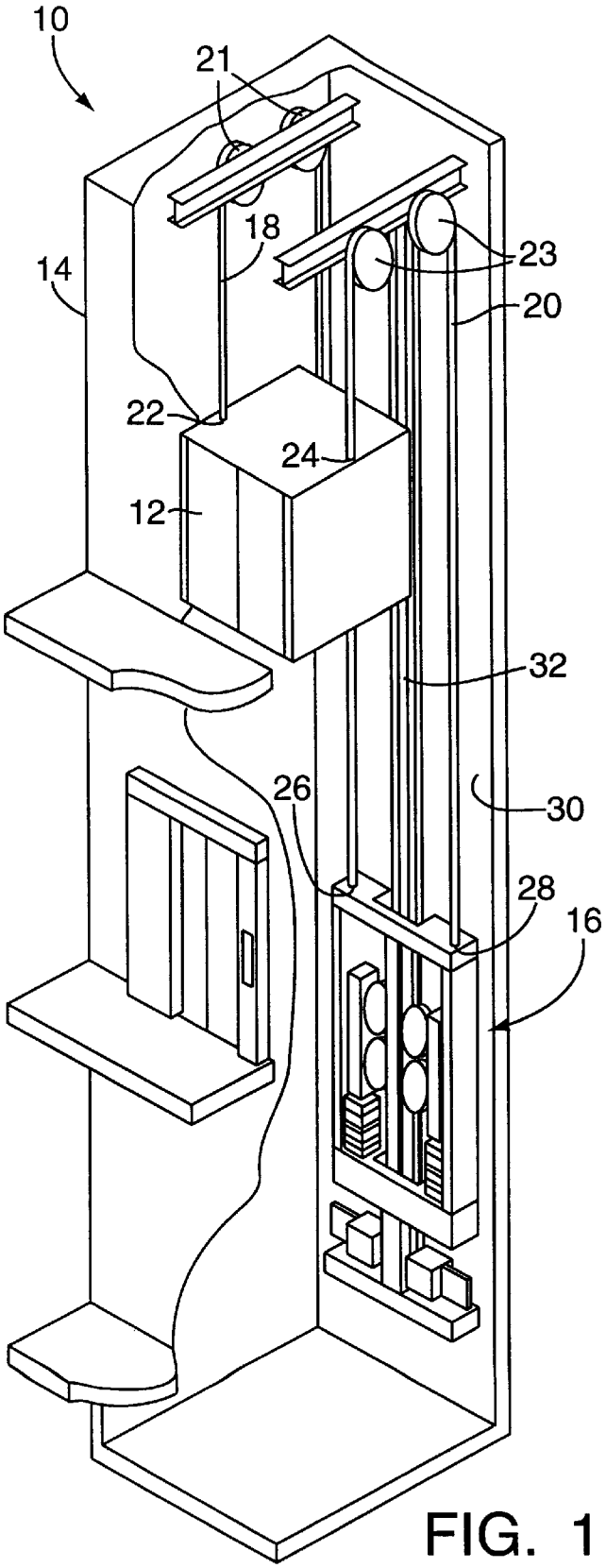
FIG. 1 is a schematic, partial orthogonal view of an elevator system according to the present invention.
Figure 2:
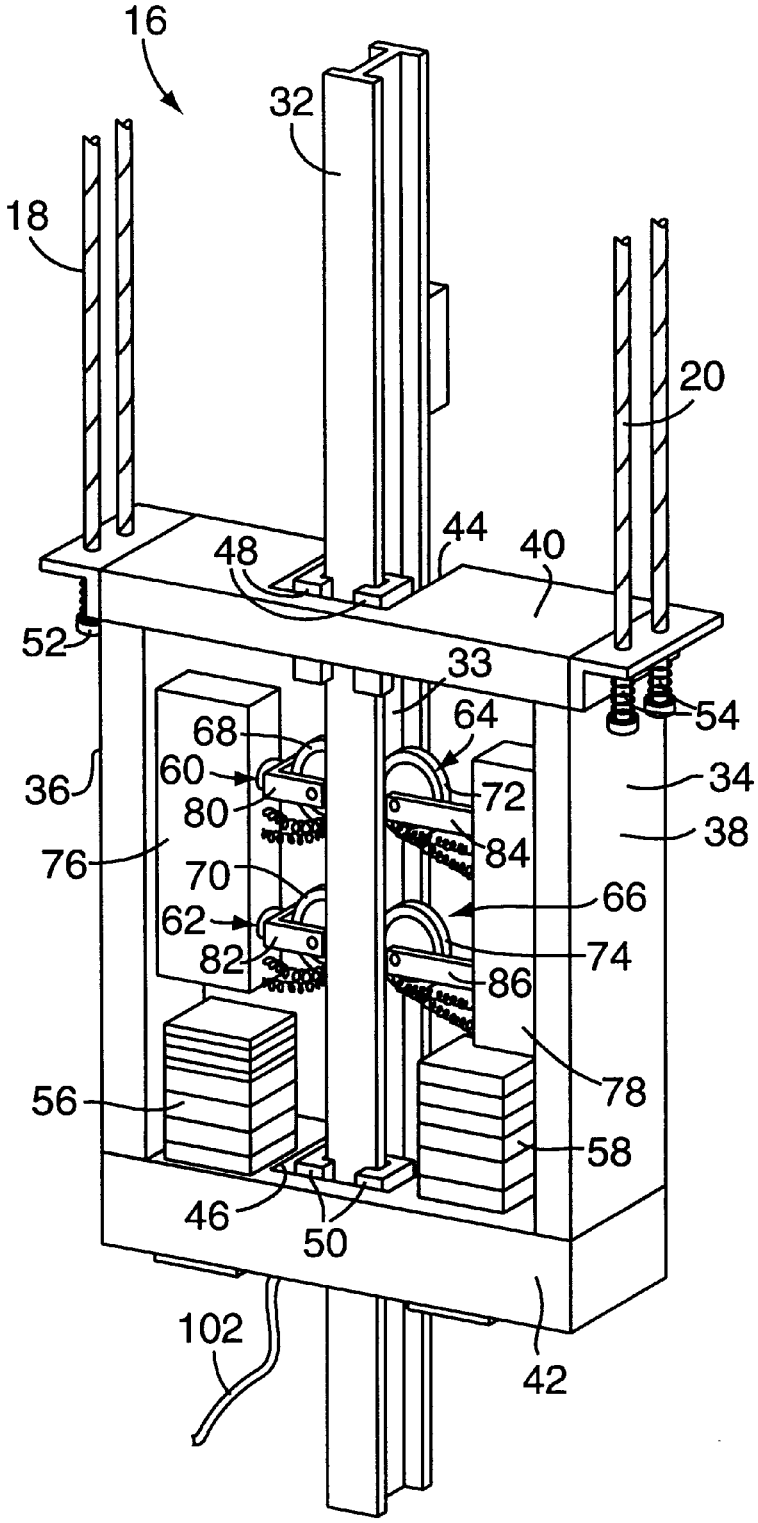
FIG. 2 is a schematic, partial orthogonal view of the counterweight and drive assembly of the elevator system according to FIG. 1.

An elevator system (10) according to the present invention is illustrated in FIG. 1. An elevator car (12) is located within a hoistway (14) and adapted for vertical movement therein. The elevator car (12) is attached to a counterweight assembly (16) by a pair of ropes (18, 20). Each rope (18, 20) is attached at a first end (22, 24) to the elevator car (12), and at a second end (26, 28) to the counterweight assembly (16). A set of fixed pulleys (21, 23) support the ropes (18, 20) for suspending the elevator car (12) and counterweight assembly (16) within the hoistway (14). As shown in FIG. 2, each rope (18, 20) may comprise a pair of ropes. The counterweight assembly (16) is adapted to move vertically along a guide rail (30) that is positioned along and generally centered with respect to a rear wall (32) of the hoistway (14).

As illustrated in FIG. 2, the counterweight assembly (16) comprises frame (34) having two side members (36,38), a top member (40), and a bottom member (42). The top and bottom members (40, 42) are each provided with central openings (44, 46) that are fitted with guide shoes (48, 50), respectively, to engage the guide rail (32). The guide rail (32) is preferably of an I-beam cross-section and the guide shoes (48, 50) engage an end flange in slot-and-groove fashion. The top member (40) is provided with rope end hitches (52, 54) as shown. If desired, weights (56, 58) can be positioned within the frame (34).

Figure 4:
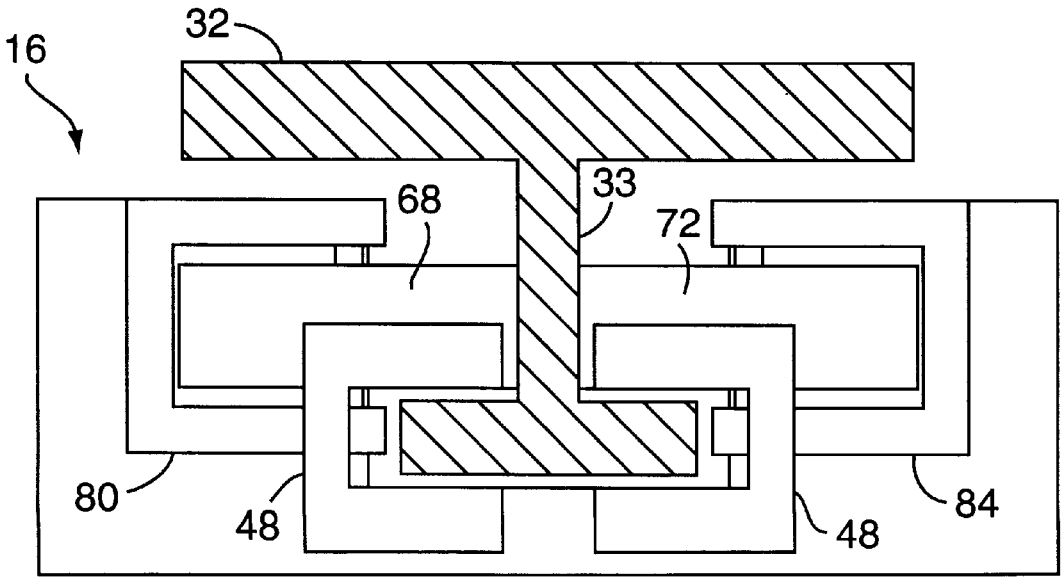
FIG. 4 is a schematic, partial top cross-sectional view of a component of the elevator system according to FIG. 1.

A plurality of drive machines (60, 62, 64, 66), each having a drive wheel (68, 70, 72, 74) associated therewith, are mounted to the frame (34) by a base (76, 78). Each drive wheel (68, 70, 72, 74) is rotatably mounted to a corresponding base (76, 78) by a bracket (80, 82, 84, 86). Each base (76, 78) includes conventional biasing means (not shown) for biasing each bracket and wheel assembly against the guide rail (32) in a direction generally orthogonal to the guide rail (32). One or both bases (76, 78) may include conventional controls for elevator operation. The drive wheels (68, 70, 72, 74) are biased with sufficient force and have sufficient friction so that when they are driven, as discussed below, the drive wheels (68, 70, 72, 74) ride up or down the guide rail (32) causing simultaneous vertical movement of the elevator car (12). As shown in the schematic, top view of FIG. 4, each drive wheel (68, 72) engages the center portion (33) of the guide rail (32).

Figure 3:
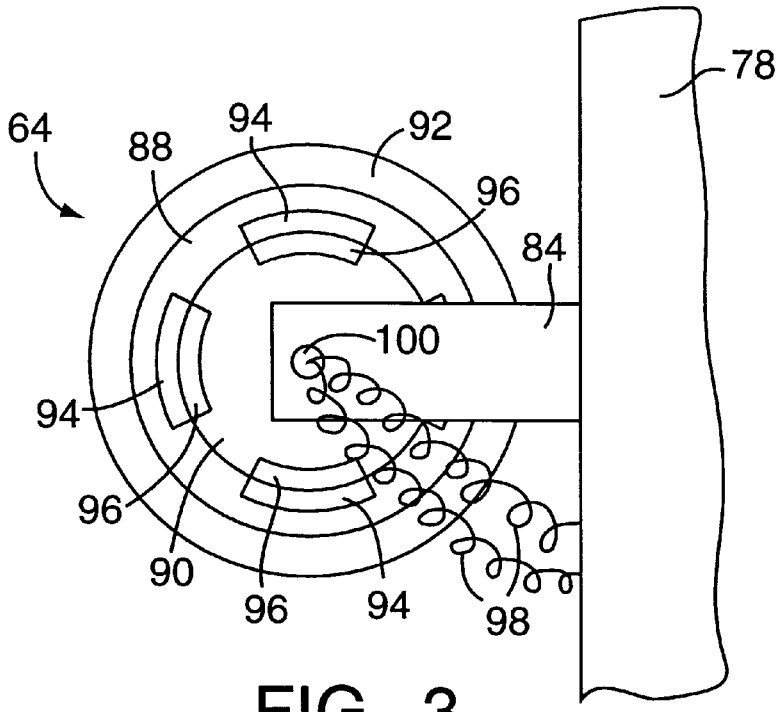
FIG. 3 is a schematic, partial side view of one of the drive machine components of the counterweight and drive assembly according to FIG. 2.

Each drive machine (60, 62, 64, 66) is configured the same and, therefore, only one of them is discussed in detail with reference to FIG. 3. Referring to FIG. 3, the drive machine (64) includes a friction tire surface (92) is fixed to the circumferential surface of a round rotor (88) that is adapted to rotate, when energized, around a disc-shaped stator (90). The stator (90) is concentrically positioned within the rotor (88) so that together they form the drive wheel (72). The rotor (88) is provided with permanent magnets (94) spaced generally evenly around. The stator (90) includes a corresponding set of windings (96). When electric current is provided to the windings (96) through attached cables (98), a magnetic field is produced which causes the magnets (94) and rotor (88) to rotate about the stator (90) and the wheel axis (100). Electric power is provided to the cables (98) through the base (78) which houses various conventional electronic circuitry and is electrically connected to an external power source (not shown) through the traveling cable (102).

While the preferred embodiment of the invention has been described, it is acknowledged that variation from the specific embodiments presented herein may be made without departing from the scope of the claimed invention.

What is claimed is:

1. An elevator system comprising:

an elevator car adapted to move within a hoistway;

a counterweight assembly attached to said elevator car by at least one rope, said counterweight assembly being adapted to move within a hoistway;

a guide rail for guiding movement of said counterweight assembly;

a plurality of drive machines attached to and movable with said counterweight assembly, each drive machine including a drive wheel adapted to frictionally engage said guide rail such that said counterweight assembly is driven along said guide rail when said drive wheels are rotated.

2. An elevator system according to claim 1, wherein said plurality of drive machines are arranged so that an equal number of drive machines are positioned on either side of said guide rail so that said corresponding drive wheels oppose each other with respect to said guide rail.

3. An elevator system according to claim 1, wherein said drive machines are electric drive machines and each include a round rotor, a tire attached to the circumferential surface of each round rotor, and a round stator positioned within each rotor to form a drive wheel therewith.

4. An elevator system according to claim 3, wherein said rotors each include a permanent magnet and said stators each include an electrical winding.

5. An elevator system according to claim 1, wherein said guide rail is an I-beam type rail.

6. An elevator system according to claim 1, further comprising drive wheel biasing means associated for biasing each said drive wheel into contact with said guide rail.

7. An elevator system according to claim 6, further comprising a pair of base members fixed to said counterweight assembly; and drive wheel brackets for rotatably mounting each said drive wheel, said drive wheel brackets being movable relative to said base members for moving said drive wheels toward or away from said guide rail.

8. A counterweight assembly for use with an elevator system having at least one counterweight guide rail, said assembly comprising a frame; and a plurality of drive machines attached to and movable with said frame, each drive machine including a drive wheel adapted to frictionally engage said guide rail such that said counterweight assembly is driven along said guide rail when said drive wheels are rotated.

9. An assembly according to claim 8, wherein said plurality of drive machines are arranged so that an equal number of drive machines are positioned on either side of said guide rail so that said corresponding drive wheels oppose each other with respect to said guide rail.

10. An elevator system according to claim 9, wherein said drive machines are electric drive machines and each include a round rotor, a tire attached to the circumferential surface of each round rotor, and a round stator positioned within each rotor to form a drive wheel therewith.

* * * * *